US008197211B1

(12) United States Patent
Liang

(10) Patent No.: US 8,197,211 B1
(45) Date of Patent: Jun. 12, 2012

(54) COMPOSITE AIR COOLED TURBINE ROTOR BLADE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 479 days.

(21) Appl. No.: 12/567,294

(22) Filed: Sep. 25, 2009

(51) Int. Cl.
*F01D 5/18* (2006.01)

(52) U.S. Cl. ..... 416/97 R; 416/96 A; 416/224; 416/241 B

(58) Field of Classification Search ..... 415/115; 416/96 A, 96 R, 97 R, 224, 226, 241 B
See application file for complete search history.

(56) References Cited

U.S. PATENT DOCUMENTS 4,314,794 A * 2/1982 Holden et al. ..... 416/97 A
4,563,128 A * 1/1986 Rossmann ..... 416/92
4,786,234 A * 11/1988 Readnour ..... 416/97 R
5,348,446 A * 9/1994 Lee et al. ..... 416/241 R
7,452,182 B2 * 11/2008 Vance et al. ..... 415/135
2010/0080687 A1 * 4/2010 Vance ..... 415/115

* cited by examiner

*Primary Examiner* — Edward Look
*Assistant Examiner* — Andrew C Knopp
(74) *Attorney, Agent, or Firm* — John Ryznic

(57) ABSTRACT

A composite turbine rotor blade that uses the high heat resistance capability of a ceramic material along with the high strength capability of a high strength metallic material. The blade includes a metallic piece with the blade root and platform with a leading edge spar and a trailing edge spar extending from the platform. The two spars form radial cooling channels for the edges of the blade. A ceramic mid-chord piece is secured between the two spars by a T-shape tip rail piece that includes a tip rail cooling channel extending from the leading edge to the trailing edge. The tip rail piece includes a hollow radial pin that extends through the root to secure to the tip rail piece to the rest of the blade and supply cooling air to the tip rail cooling channel.

13 Claims, 4 Drawing Sheets

View A-A

View B-B

COMPOSITE AIR COOLED TURBINE ROTOR BLADE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine rotor blade with near wall cooling.

2. Description of the Related Art Including Information Disclosed Under 37 CFR 1.97 and 1.98

A gas turbine engine, such as an industrial gas turbine (IGT) engine, includes a turbine with multiple rows or stages or stator vanes that guide a high temperature gas flow through adjacent rotors of rotor blades to produce mechanical power and drive a bypass fan, in the case of an aero engine, or an electric generator, in the case of an IGT. In both cases, the turbine is also used to drive the compressor.

The efficiency of the engine can be increased by passing a higher temperature gas flow into the turbine section. However, the highest temperature gas than can be passed into the turbine is limited to the material properties of the turbine, especially the first stage stator vanes and rotor blades since these airfoils are exposed to the highest temperature gas flow. To allow for temperatures high enough to melt these airfoils, complex airfoil internal cooling circuits have been proposed to provide convection, impingement and film cooling for the airfoils to allow even higher temperatures. However, the pressurized cooling air used for cooling of the airfoils is typically bled off from the compressor. The cooling air thus is not used for producing mechanical work but reduces the efficiency of the engine. It is therefore useful to also minimize the amount of cooling air used while at the same time maximizing the cooling capability of this minimized cooling air.

For an airfoil used in a turbine of a gas turbine engine, the airfoil leading edge, the airfoil suction side immediately downstream of the leading edge, as the airfoil trailing edge region experiences a higher hot gas side external heat transfer coefficient than the mid-chord section of the pressure side and downstream of the suction side surfaces. The heat load for the airfoil aft section is higher than the forward section. Also, due to a hot gas leakage cross flow effect, the blade tip section will also experience high heat load. Cooling of the blade leading edge, trailing edge and tip peripheral edge becomes the most difficult region for blade cooling designs. Without a good cooling circuit design, high cooling flow consumption is required for the blade edge cooling. As the TBC technology improves, more industrial gas turbine blades are applied with a relatively thick or low conductivity TBC. The cooling air flow demand will then be greatly reduced while allowing for higher turbine inlet temperatures. As a result, the cooling flow demand for these high heat load regions of the blade needs to be eliminated.

Composite turbine blades have been proposed in the past in order to take advantage of the high temperature resistant properties of ceramic materials. Blade or vanes have been made using metal and ceramic materials (CMC or Carbon-Carbon materials) to form a single piece airfoil. However, one major problem while these composite airfoils have not been used is due to the large difference between the coefficient of thermal of expansion of metal and ceramic. The metal material will expand much more than the ceramic material, and thus very high stress loads are formed at the bonded surfaces. This results in cracks or complete breaks.

BRIEF SUMMARY OF THE INVENTION

It is an object of the present invention to provide for a turbine rotor blade with a low cooling air flow requirement that can operate under a higher temperature than the prior art investment cast turbine rotor blades.

It is another object of the present invention to provide for a turbine rotor blade with a lightweight blade design over the prior art all metal turbine rotor blades for a higher $AN^2$ design.

It is another object of the present invention to provide for a turbine rotor blade with an airfoil mid-chord section that has less surface area required for hot gas side convection cooling.

It is another object of the present invention to provide for a turbine rotor blade with a high temperature resistant composite material used on the mid-chord section in order to eliminate the main body and pressure side tip edge film cooling and thus reduce the blade total cooling flow demand.

These objectives and more can be achieved by the composite turbine rotor blade of the present invention which includes a mid-chord section of the airfoil made of a high temperature resistant composite material that is positioned between two near wall cooled radial extending metal spars that form the leading edge and trailing edge of the blade. The two spars have radial near wall cooling channels with internal pin fins to provide cooling for the leading and trailing edges. A mid-chord T-shaped attachment device is used to secure the composite mid-chord airfoil piece to the blade platform and include a cooling air channel to channel cooling air from the support to a chordwise extending cooling channel along the tip rail. A row of high density cooling holes is used in the chordwise tip rail cooling channel to induce an air curtain effect for reducing the blade tip leakage flow.

DETAILED DESCRIPTION OF THE INVENTION

Figure 1:
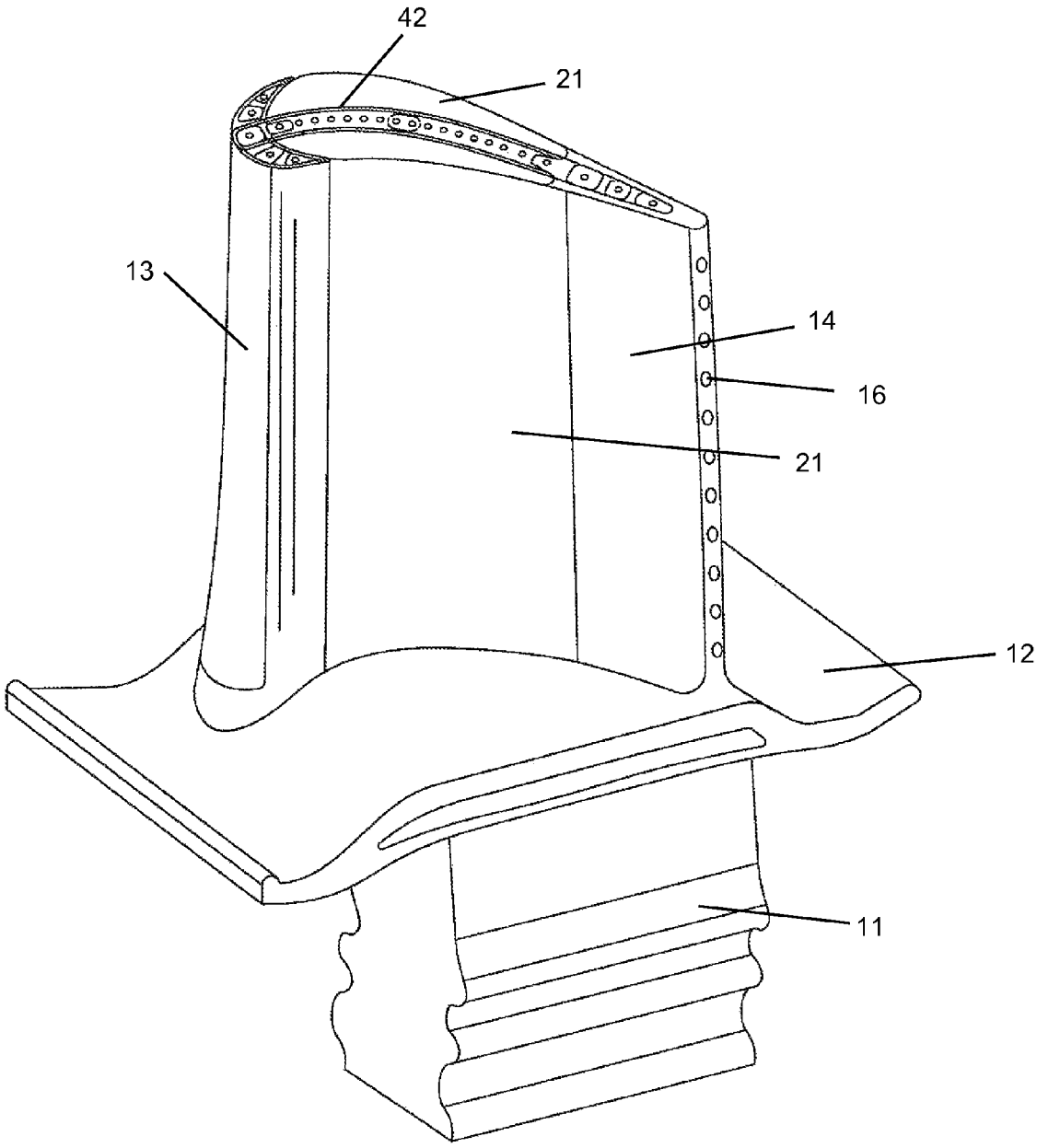
FIG. 1 shows an isometric view of the composite blade of the present invention.

The present invention is a turbine rotor blade for use in a gas turbine engine such as an industrial gas turbine engine for the first stage of the turbine, or even in the second stage. The composite blade is shown in FIG. 1 and includes a blade root 11, a platform 12 extending from the root 11, and an airfoil section that includes a leading edge and a trailing edge and a pressure side wall and a suction side wall extending between the two edges. A blade tip with a tip rail is formed on the top of the airfoil section.

Figure 2:
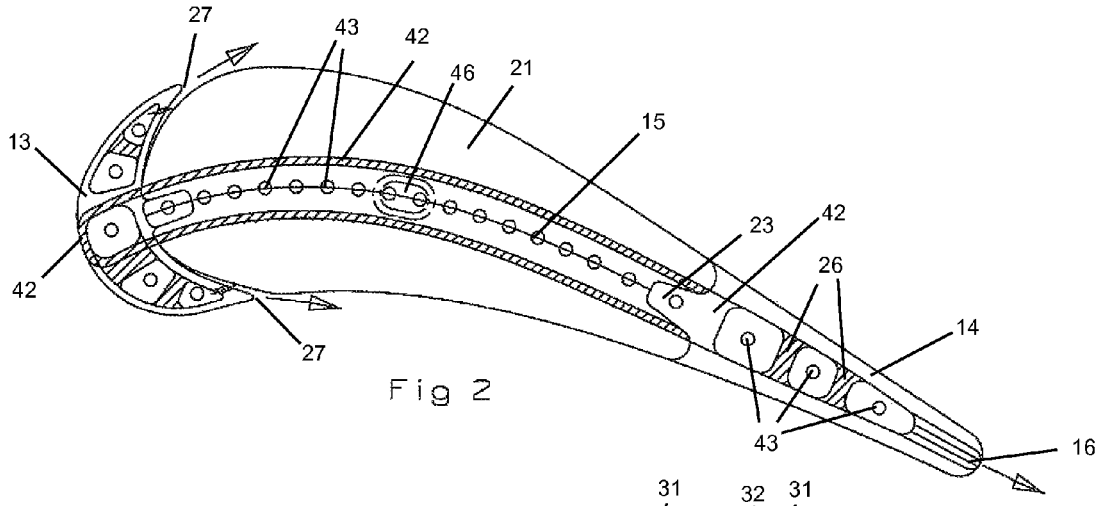
FIG. 2 shows a cross section view along the spanwise axis of the blade of FIG. 1.

The composite blade of FIG. 1 includes a leading edge spar 13 and a trailing edge spar 14 extending from the root 11 and platform 12 to form a single piece metallic part of the blade. A mid-chord section 21 made from a high temperature resistant material such as CMC or Carbon-Carbon material is secured between the two spars 13 and 14 to form the mid-chord airfoil section of the blade. FIG. 2 shows a cross section view along the spanwise direction of the blade with the leading edge spar 13 and the trailing edge spar 14 on the two ends of the ceramic mid-chord section 21. The L/E spar 13 and the T/E spar 14 both have radial cooling channels with pin fins to pass cooling air and provide cooling to the respective edge of the blade.

Figure 3:
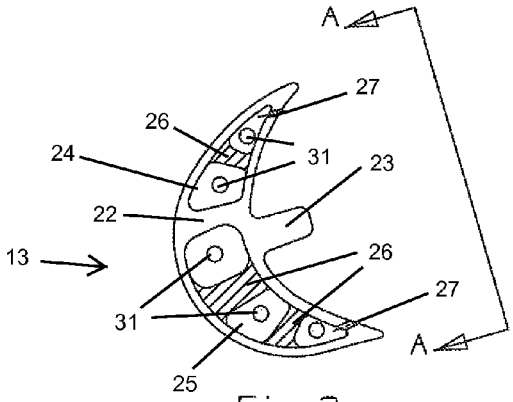
FIG. 3 shows a cross section view of the leading edge spar of the blade of FIG. 1.

FIG. 3 shows details of the L/E spar 13 that includes a suction side radial cooling channel 24 and a pressure side radial cooling channel 25 both separated by a flow divider wall 22. Both radial cooling channels 24 and 25 have rows of pin fins 26 extending from a front wall to a back wall to enhance the heat transfer coefficient of the spar. The L/E spar 13 also includes a radial extending rib 23 along the entire spar that forms a tongue to fit within the groove of the ceramic mid-chord section 21. The L/E spar 13 also includes a row of cooling holes 27 on the suction side end and a row of cooling holes 27 on the pressure side end, both rows of cooling holes 27 extending the spanwise length of the spar 13. The two radial cooling channels 24 and 25 also have tip cooling holes 31 located at the tip end of the channels.

Figure 4:
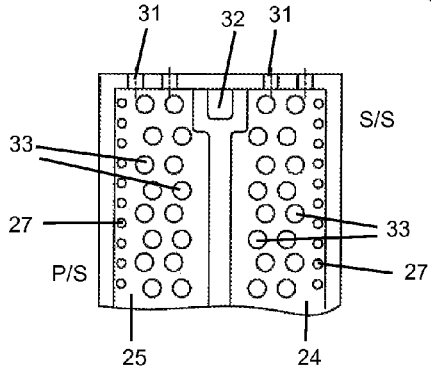
FIG. 4 shows a cross section view from the back side of the leading edge spar of FIG. 3.

FIG. 4 shows a cross section view from the back side of the L/E spar 13 of FIG. 3. The L/E spar 13 includes a pressure side (P/S) and a suction side (S/S) with a chordwise extending groove 32 opened on the top end to fit the blade tip retaining pin described below. The tip cooling holes 31 open on the top end and the pin fins 33 are arranged in a staggered arrangement to promote turbulent flow of the cooling air through the channels. The two rows of cooling holes 27 extend along the outer ends of the channels 24 and 25. The L/E spar 13 includes a rove that opens in the mid-chord of the top surface to fit the T-shape tip rail piece 40 described below.

The T/E spar 14 includes similar radial cooling channels with pin fins of that in the L/E spar 13. The T/E spar 14 extends from the pressure wall side to the suction wall side with the pin fins extending across the cooling channel from the P/S to the S/S as seen in FIG. 2. The T/E spar 14 also includes a radial extending rib 23 that fits within the radial groove 36 of the mid-chord piece 21. A row of exit cooling holes 36 are formed on the T/E side of the spar 14 to discharge cooling air from the radial cooling channel of the T/E spar 14 and cool the trailing edge section of the blade. The top of the T/E spar 14 ends underneath the aft end of the T-shape tip rail piece 40 described below.

Figure 5:
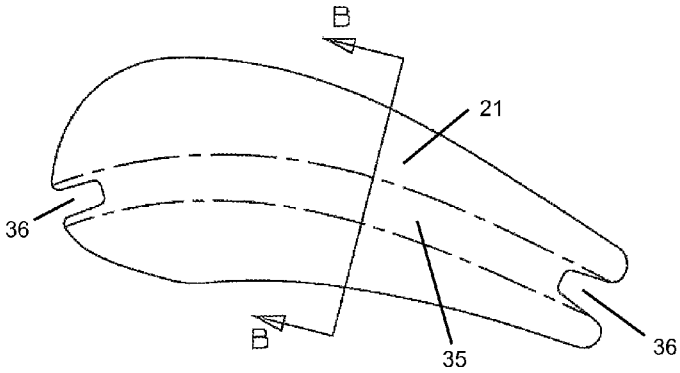
FIG. 5 shows a cross section view from the top of the mid-chord section of the composite blade of FIG. 1.
Figure 6:
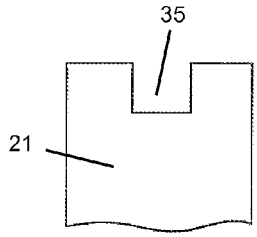
FIG. 6 shows a cross section view from the back of the mid-chord section of FIG. 5.
Figure 7:
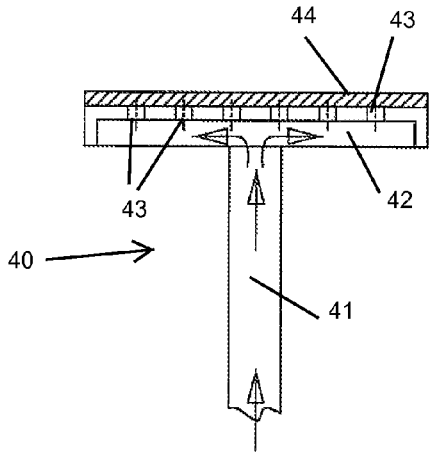
FIG. 7 is a cross section view from the side of the tip rail attachment pin of the composite blade of FIG. 1.

The mid-chord section 21 of the composite blade is shown in FIGS. 5 and 6, where in FIG. 6 the mid-chord section 21 includes a pressure wall surface and a suction wall surface, a spanwise extending groove 36 on the front or forward side and a spanwise extending groove 36 on the aft side to fit the ribs 23 extending from the L/E and T/E spars 13 and 14. A tip rail groove 35 opens on the top of the mid-chord piece 21 and extends along the entire mid-chord length to fit the tip rail retaining piece described below. FIG. 6 shows a view B-B through the FIG. 5 from the back of the mid-chord piece 21 with the tip rail groove 35 opening onto the top surface. The mid-chord piece 21 is made from a high temperature resistant composite material that can withstand a higher temperature than the metallic material but has less strength and is more brittle. Thus the need for the more rigid spars 13 and 14 to provide support for the mid-chord piece 21.

Figure 8:
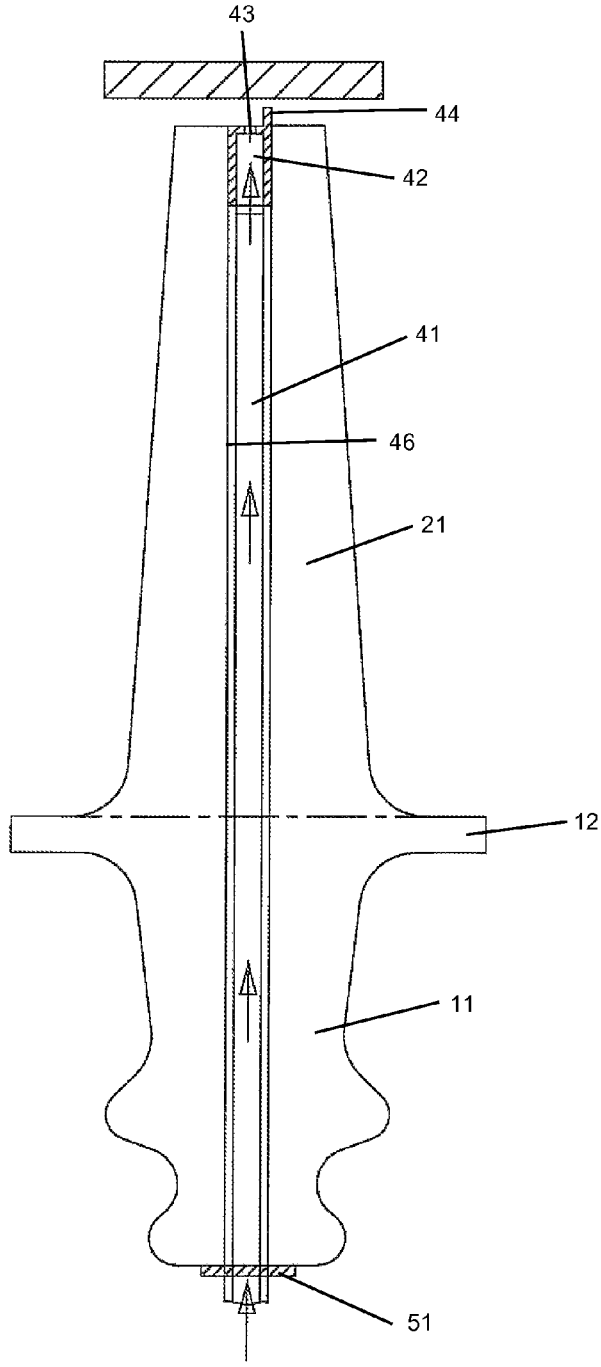
FIG. 8 shows a cross section view from the edge of the composite blade with the tip rail attachment pin in place.
Figure 9:
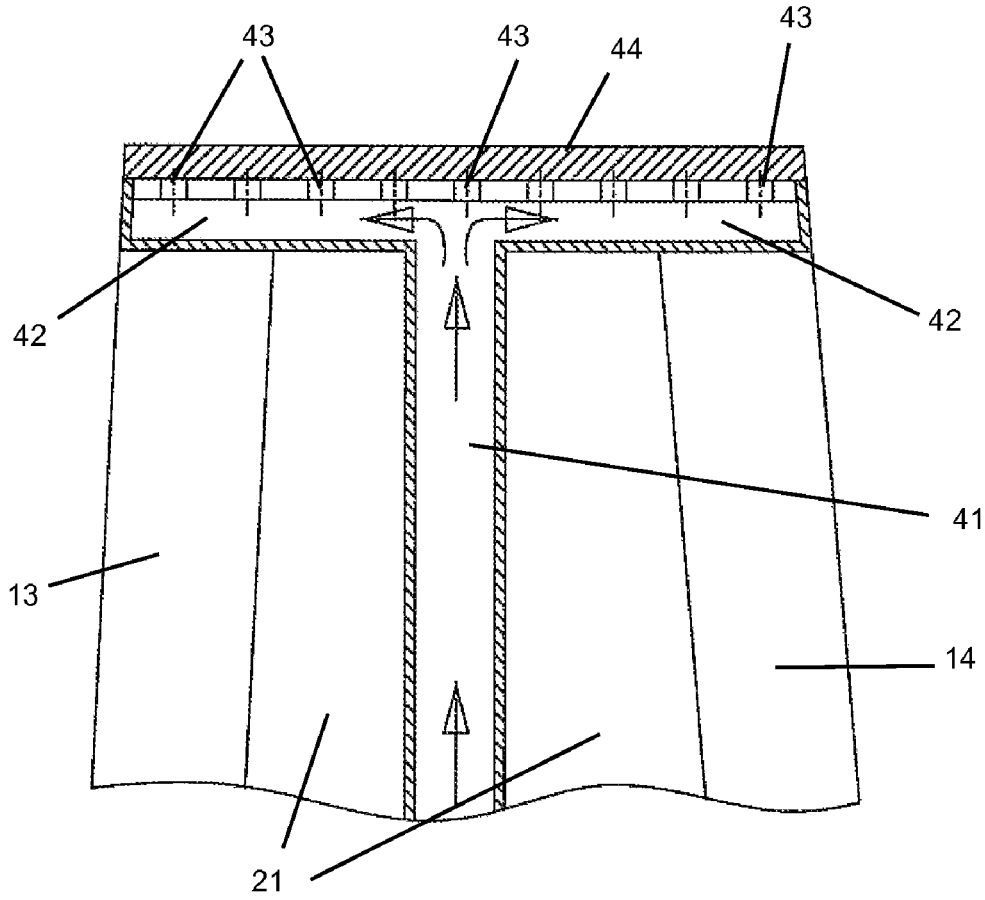
FIG. 9 shows a cross section view of the composite blade from the side with the T-shape tip rail piece in position.

With the ceramic mid-chord piece 21 secured within the ribs 23 of the L/E spar 13 and T/E spar 14, a T-shape tip rail piece 40 that has a hollow pin 41 extending from an underside of a top end or tip rail cooling channel 44 is inserted within a radial extending hole 46 that extends out through the bottom end of the root 11 to secure the various pieces of the blade together. The tip rail piece includes a tip rail cooling channel 44 extending from the forward end to the aft end and on one side of the top end 42 as seen in FIG. 8. The top end 42 includes tip cooling holes 43 opening along the inner side of the tip rail 44 and also extend along the chordwise length of the top piece 42. The hollow pin 41 forms a cooling air passage and includes a surface for an attachment lock 51 on the bottom end to tighten the tip rail piece within the blade assembly. Cooling air from the radial channel 41 flows up through the mid-chord piece 21 and into the tip rail channel 42 to provide cooling for the blade tip. The cooling air from the tip rail channel 42 then flows out through the row of tip rail cooling holes 43 to provide cooling for the blade tip and the tip rail 44, the tip rail piece 40 extends from the leading edge surface of the L/E spar 13 to the trailing edge surface of the T/E spar 14 so that the two spars 13 and 14 are positioned below the tip rail piece 40.

The blade root includes cooling air supply cavities that connect an external source of pressurized cooling air to the tip rail piece radial cooling channel 41 and the radial cooling channels formed within the L/E and T/E spars 13 and 14 to provide for the total cooling of the composite blade. Cooling air flowing through the radial cooling channels 24 and 25 formed within the L/E spar 13 flows around the pin fins 26 and along the inner wall surfaces of the channels to provide near wall cooling for the leading edge of the blade. Some of the cooling air is discharged out through the two rows of film cooling holes 27 on the ends of the spar 13. The remaining cooling air is discharged out through the tip cooling holes 31. Cooling air flowing in the radial cooling channel in the T/E spar 14 also flows around the pin fins and along the wide walls to provide cooling to this section of the blade. All of the cooling air in the T/E spar 14 cooling channel flows out through the row of exit cooling holes 16 spaced along the trailing edge of the blade. Because the P/S channel 25 is separated from the S/S channel 24 in the L/E spar 13, both cooling air pressures can be different so that a BFM (backflow margin) on the pressure wall side and the suction wall side can be met and to prevent circumferential flow distribution issues of the film cooling air.

The cooling air flowing through the tip rail hollow pin 41 flows into the tip rail channel 42 and then through the row of tip rail cooling holes 43 spaced along the entire blade tip from the leading edge to the trailing edge to provide cooling for the blade tip and the tip rail 44. The tip rail cooling holes 43 are high density cooling holes in order to induce an air cushion effect for a reduction of blade tip leakage flow.

The tongue and groove connection between the mid-chord piece and the two spars allows for positioning of the mid-chord piece with respect to the L/E and T/E pieces or spars of the blade and form a close tolerance airfoil surface for the composite blade. The mid-chord T-shape tip rail piece is used to fix the composite mid-chord piece to the blade platform in the radial position. Major advantages of the cooling circuit and construction of the composite blade of the present invention is described below. A low cooling flow consumption is achieved due to a small metal blade surface being used compared to the prior art all-metallic blades. The use of CMC or Carbon-Carbon high temperature material on the airfoil mid-chord section reduces the hot gas side convection surface needed to be cooled. The use of near wall cooling for the L/E and T/E spars will yield a very high cooling effectiveness and therefore reduce the blade cooling air flow requirement. Since both side walls for the near wall cooling are exposed to external heat load, this yields a low through-wall thermal gradient for the spar structure which therefore eliminates the TMF (thermal mechanical fatigue) issue normally experienced in the near wall cooling design, high temperature composite material is used on the mid-chord blade section which will eliminate the main body and pressure side tip edge film cooling and thus reduce the blade total cooling flow demand and simplify the manufacturing complexity for the blade. The composite blade construction design yields a lightweight blade design which will allow for the turbine to be designed at a much higher $AN^2$ (A being the cross sectional surface area of a rotating blade and N the rotational speed of the blade). High density tip cooling holes used in the tip rail for sealing of blade tip leakage flow.

I claim the following:

1. A composite turbine rotor blade comprising:

a blade root with a platform extending outward;

a leading edge spar and a trailing edge spar extending from the root and platform;

the leading edge spar forming a leading edge region of the blade;

the trailing edge spar forming a trailing edge region of the blade;

the leading edge spar and the trailing edge spar both forming a radial extending cooling channel;

the leading edge spar and the trailing edge spar both having a radial extending rib extending inward from the respective spar;

the blade root, the platform and the two spars all being formed from a single piece and from a metallic material;

a mid-chord piece having a pressure side wall and a suction side wall and extending from the platform to a blade tip region, the mid-chord piece having a forward side with a radial extending groove and an aft side with a radial extending groove, the two grooves being sized to fit the ribs from the spars to secure the mid-chord piece to the spars; and, a T-shape tip rail piece having a tip rail cooling channel extending from the leading edge spar to the trailing edge spar, the tip rail piece having a hollow radial pin extending from the tip rail channel at around a mid-chord position, the tip rail piece having a row of tip cooling holes extending from the forward end to the aft end, the tip rail piece securing the mid-chord piece to the blade root and platform against radial displacement, and the tip rail piece being made from a high temperature resistant composite material.

2. The composite turbine rotor blade of claim 1, and further comprising:

the leading edge spar includes a groove opening on the top side sized to fit the tip rail piece.

3. The composite turbine rotor blade of claim 1, and further comprising:

the leading edge spar includes a row of film cooling holes on a suction side and a row of film cooling holes on the pressure side both connected to the radial cooling channel.

4. The composite turbine rotor blade of claim 1, and further comprising:

the leading edge spar includes a flow divider within the radial cooling channel to separate the radial cooling channel into a pressure side radial cooling channel and a suction side radial cooling channel.

5. The composite turbine rotor blade of claim 1, and further comprising:

the trailing edge spar includes a groove opening on the top side sized to fit the tip rail piece.

6. The composite turbine rotor blade of claim 1, and further comprising:

the trailing edge spar includes a row of exit cooling holes connected to the radial cooling channel and opening onto the trailing edge of the blade.

7. The composite turbine rotor blade of claim 1, and further comprising:

hollow radial pin of the tip rail piece forms a cooling air supply channel for the tip rail cooling channel.

8. The composite turbine rotor blade of claim 1, and further comprising:

a hollow radial pin of the tip rail piece extends out through an opening in the root bottom surface; and, a retainer means to secure the tip rail piece to the mid-chord piece and the two spars against radial displacement.

9. The composite turbine rotor blade of claim 1, and further comprising:

the tip rail channel passes along the mid-chord length of the blade from the leading edge to the trailing edge of the blade.

10. The composite turbine rotor blade of claim 1, and further comprising:

the tip rail piece includes a tip rail extending from the leading edge to the trailing edge; and, the row of tip rail cooling holes opens onto the tip adjacent to the tip rail on the pressure side of the tip rail.

11. The composite turbine rotor blade of claim 1, and further comprising:

the leading edge spar and the trailing edge spar and the mid-chord piece form an airfoil of the blade.

12. The composite turbine rotor blade of claim 1, and further comprising:

the mid-chord piece is formed from a CMC or Carbon-Carbon composite.

13. The composite turbine rotor blade of claim 1, and further comprising:

the tip rail piece forms the blade tip.

* * * * *